US007827962B2

(12) United States Patent
Weizenauer et al.

(10) Patent No.: US 7,827,962 B2
(45) Date of Patent: Nov. 9, 2010

(54) HIGH-PRESSURE ACCUMULATOR BODY WITH INTEGRATED DISTRIBUTOR BLOCK

(75) Inventors: Christoph Weizenauer, Garsten (AT); Jochen Walther, Stuttgart (DE); Markus Degn, Altmuenster (AT); Gernot Payer, St. Georgen (AT); Sven Voelter, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 30 days.

(21) Appl. No.: 12/162,305

(22) PCT Filed: Nov. 30, 2006

(86) PCT No.: PCT/EP2006/069147

§ 371 (c)(1),
(2), (4) Date: Dec. 3, 2008

(87) PCT Pub. No.: WO2007/085313

PCT Pub. Date: Aug. 2, 2007

(65) Prior Publication Data

US 2009/0223486 A1 Sep. 10, 2009

(30) Foreign Application Priority Data

Jan. 26, 2006 (DE) ..... 10 2006 003 639

(51) Int. Cl.
*F02M 69/46* (2006.01)
*F02M 55/02* (2006.01)

(52) U.S. Cl. ..... 123/456; 123/467; 123/468

(58) Field of Classification Search ..... 123/456, 123/467, 468, 469; 138/26, 30, 40, 44
See application file for complete search history.

(56) References Cited

U.S. PATENT DOCUMENTS

| | | | | |
|---|---|---|---|---|
| 5,884,607 | A * | 3/1999 | Schiller et al. | 123/467 |
| 5,954,031 | A | 9/1999 | Ogiso et al. | |
| 6,119,728 | A * | 9/2000 | Seidel-Peschmann et al. | 138/26 |
| 6,401,691 | B1 | 6/2002 | Kawano et al. | |
| 6,615,800 | B1 | 9/2003 | Frank et al. | |
| 6,807,944 | B2 * | 10/2004 | Mizuno et al. | 123/467 |
| 6,848,477 | B2 * | 2/2005 | Treusch et al. | 138/44 |
| 6,901,913 | B1 | 6/2005 | Tsuchiya et al. | |
| 6,905,002 | B2 * | 6/2005 | Bagga et al. | 181/233 |
| 6,925,989 | B2 * | 8/2005 | Treusch et al. | 123/456 |
| 6,935,314 | B2 * | 8/2005 | Zdroik et al. | 123/456 |
| 6,948,585 | B2 * | 9/2005 | Lei et al. | 181/233 |
| 7,021,290 | B2 * | 4/2006 | Zdroik et al. | 123/456 |

(Continued)

FOREIGN PATENT DOCUMENTS

DE 19942855 A1 3/2001

(Continued)

*Primary Examiner*—Thomas N Moulis
(74) *Attorney, Agent, or Firm*—Ronald E. Greigg

(57) ABSTRACT

The invention relates to a fuel injection system for a multi-cylinder internal combustion engine having a first high-pressure accumulator and having a second high-pressure accumulator. The fuel injection system also has a high-pressure pump, wherein the first and the second high-pressure accumulators have a number of ports for injector supply lines corresponding to the number of cylinders of the internal combustion engine. A damping volume for damping pressure pulsations between the high-pressure accumulators and the high-pressure pump is integrated into one of the high-pressure accumulators.

19 Claims, 5 Drawing Sheets

U.S. PATENT DOCUMENTS

| | | | | |
|---|---|---|---|---|
| 7,131,427 | B2 * | 11/2006 | Kawasaki et al. | 123/456 |
| 7,143,748 | B2 * | 12/2006 | Zdroik et al. | 123/467 |
| 7,146,965 | B1 * | 12/2006 | Li et al. | 123/456 |
| 7,406,946 | B1 * | 8/2008 | Watanabe et al. | 123/470 |
| 7,422,001 | B2 * | 9/2008 | Kaneko | 123/456 |
| 2003/0234138 | A1 | 12/2003 | Bagga et al. | |
| 2004/0149513 | A1 | 8/2004 | Lei et al. | |

FOREIGN PATENT DOCUMENTS

| | | | |
|---|---|---|---|
| EP | 0785357 | A1 | 7/1997 |
| EP | 0995902 | A2 | 4/2000 |
| WO | 2004001265 | A1 | 12/2003 |

* cited by examiner

Fig. 3.1
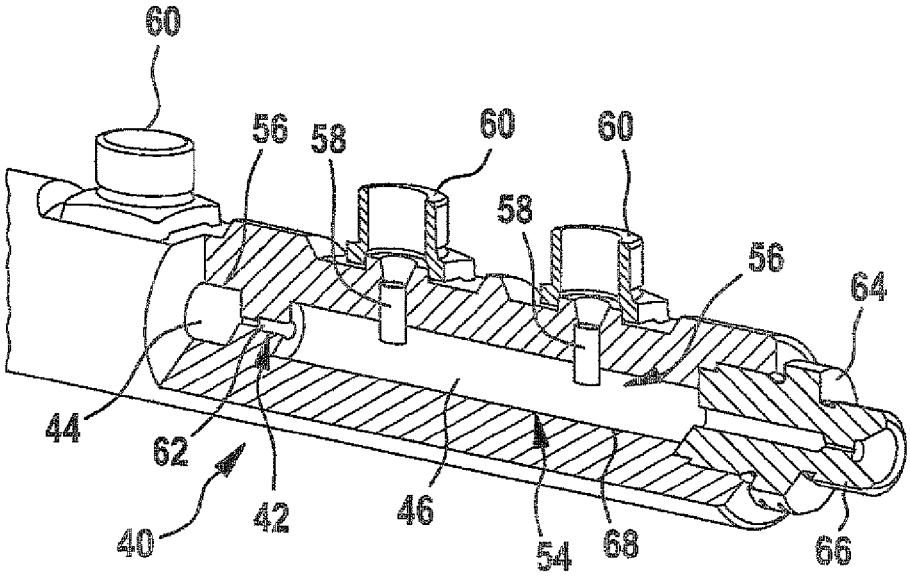
Fig. 3.2
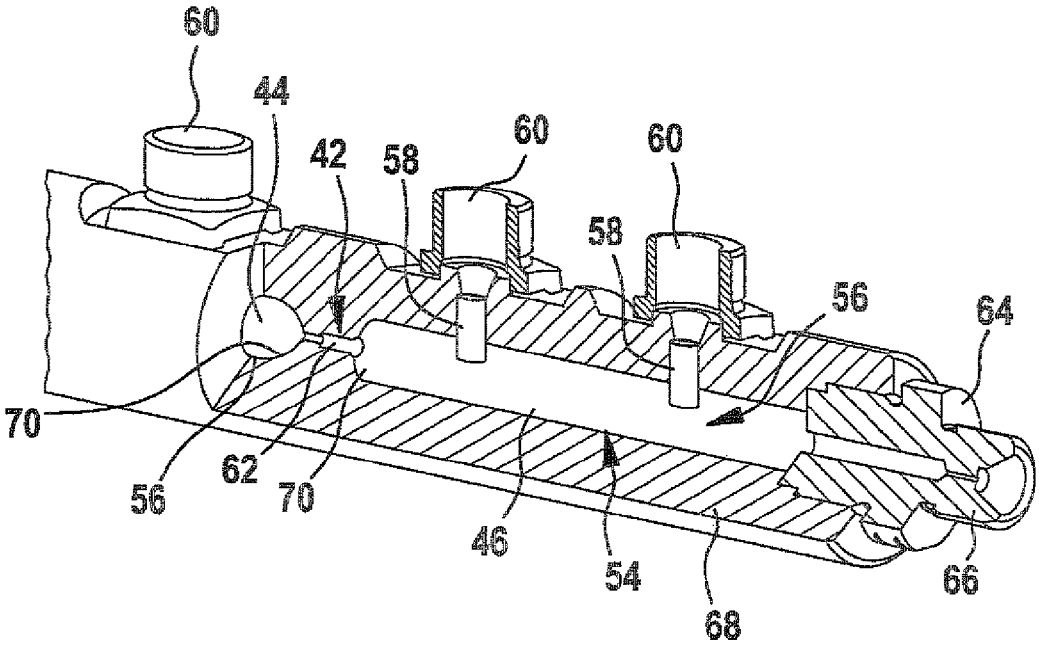

Fig. 4.1
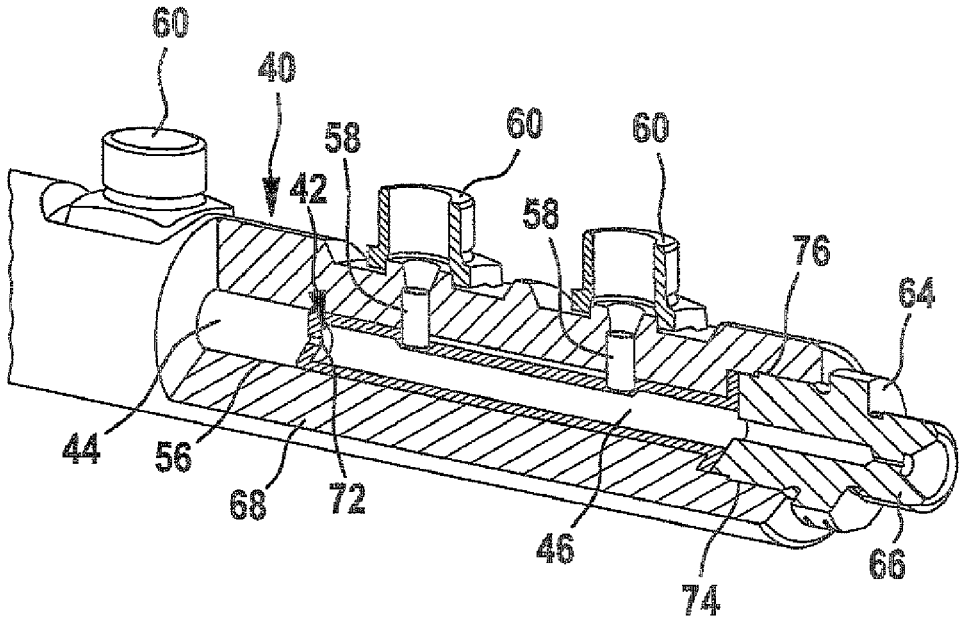
Fig. 4.2
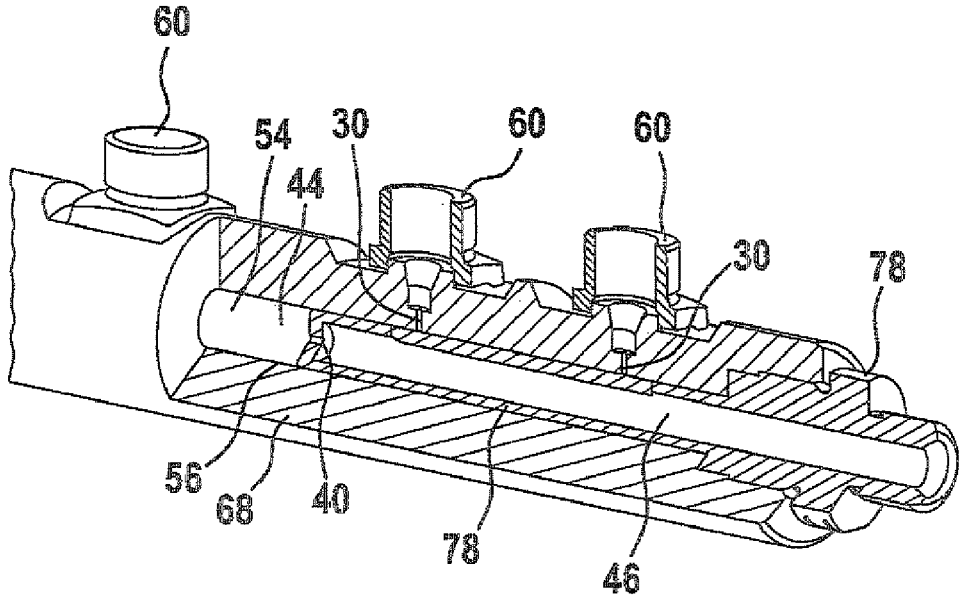

Fig. 5
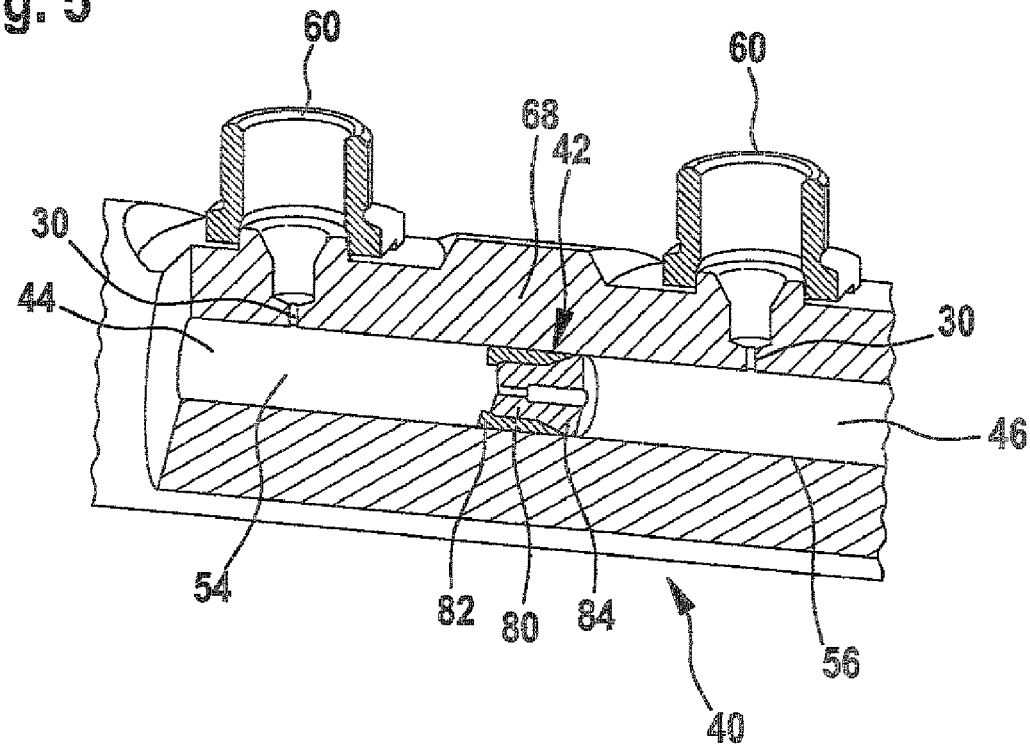
Fig. 5.1
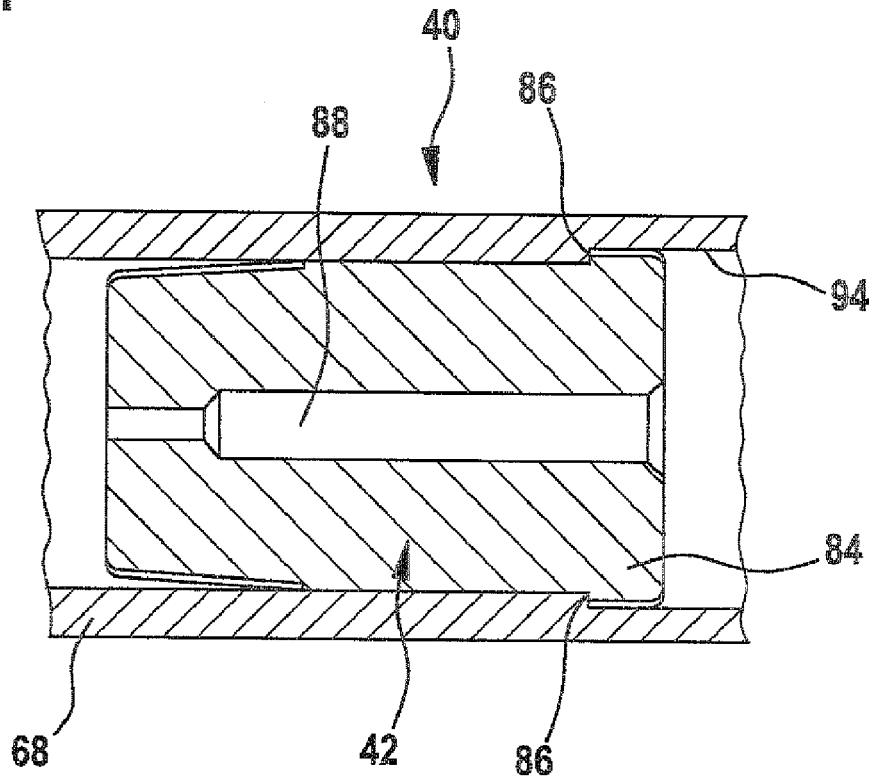

Fig. 5.2
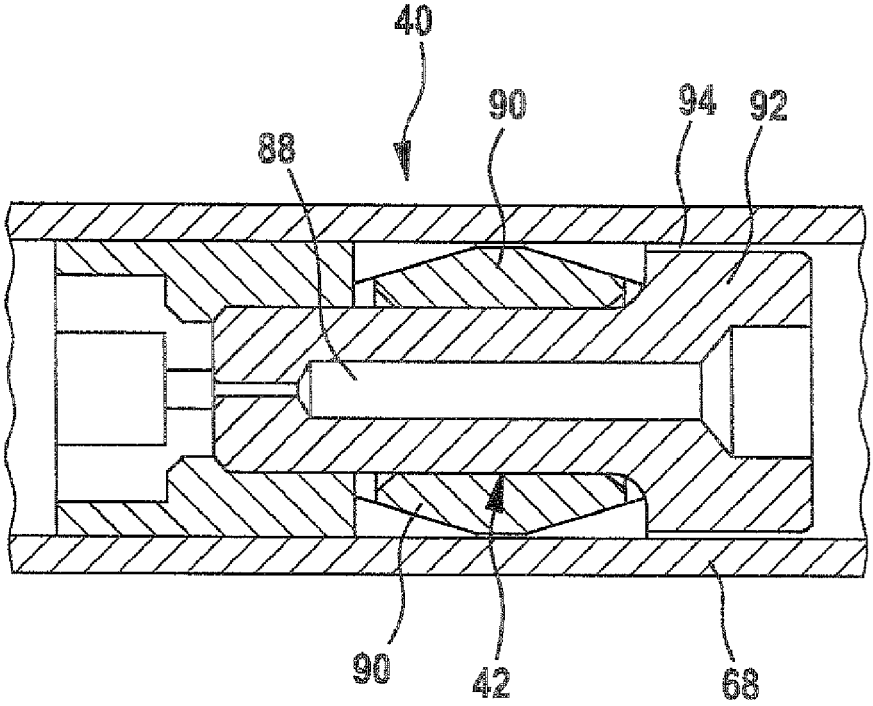
Fig. 5.3
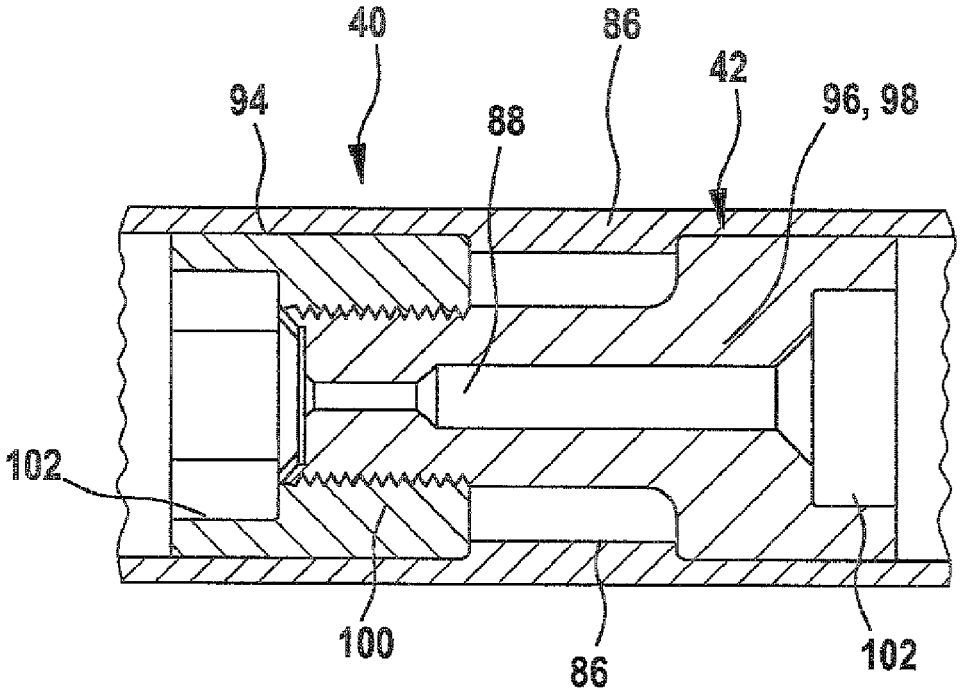

HIGH-PRESSURE ACCUMULATOR BODY WITH INTEGRATED DISTRIBUTOR BLOCK

CROSS-REFERENCE TO RELATED APPLICATION

This application is a 35 USC 371 application of PCT/EP 2006/069147 filed on Nov. 30, 2006.

BACKGROUND OF THE INVENTION

1. Field of the Invention

The invention relates to a fuel injection system for a multicylinder internal combustion engine.

2. Description of the Prior Art

DE 100 60 785 A1 relates to a fuel injection apparatus equipped with a high-pressure fuel accumulator. Branch lines can be screwed to the high-pressure fuel accumulator, each containing a throttle for reducing pressure pulsations in the fuel injection apparatus. The throttles are each composed of a tube element that is either mounted to an end of the branch line to which a connecting head is attached or is accommodated inside the branch line, close to that end. Throttle elements in high-pressure accumulators (common rails) are used for pressure wave damping inside the body of the high-pressure accumulator. To achieve this, for example cylindrical throttle elements are press-fitted into connecting bores of the high-pressure accumulator (common rail) that lead to the individual fuel injectors or also to the high-pressure pump acting on the high-pressure accumulator. The throttle elements press-fitted into the connecting bores serve to improve the damping of pressure pulsations inside the fuel injection system, thus permitting an increase in the pressure-tightness of the individual components.

DE 20 2004 019 820.7 relates to a fuel injection apparatus for a diesel engine. A fuel injection apparatus includes a high-pressure fuel accumulator and a number of branch lines serving to convey fuel out of the high-pressure fuel accumulator. These branch lines each have a connecting head at their one respective end for connecting the branch line to an associated connection fitting of the high-pressure fuel accumulator, while a throttle is mounted in each of the branch lines. The throttle is embodied in a support element that is mounted in the region of the connecting head by means of attaching elements, which are embodied with the same design as the connecting head and which narrow an internal diameter of the branch line at the two ends of the support element. The throttle is provided in the support element and is embodied in the form of a through bore with a first partial bore and a second partial bore, i.e. it has two stages. During the upsetting of the connecting head, the through bore is protected by a stepped, cylindrical inner mandrel that is inserted into it and is embodied as recoverable. The support element preferably has a cylindrical circumference surface.

In internal combustion engines with six and more cylinders, two high-pressure accumulators are used, each of which supplies fuel to the fuel injectors of the cylinders of a respective cylinder bank. The two high-pressure accumulators (common rails) are connected to each other by a connecting line that provides for a pressure compensation between the high-pressure accumulators. In order to damp the pressure pulsations that occur in the two high-pressure accumulators, it is also possible for a distributor block to be provided. The distributor block is acted on by a high-pressure pump that compresses the fuel to the system pressure and maintains this system pressure in the two high-pressure accumulators. The two high-pressure accumulators are supplied with fuel by the distributor block, which is acted on by the high-pressure pump and in which pulsations are damped.

SUMMARY AND ADVANTAGES OF THE INVENTION

According to the embodiment proposed by the invention, the distributor block, which was previously embodied in the form of a separate component, is integrated into one of the two high-pressure accumulators that supply fuel to the multicylinder internal combustion engine. In particular, this is implemented by integrating a throttle into the cavity of the relevant high-pressure accumulator (common rail). By integrating the throttle into the cavity, which is embodied for example as a bore, of the relevant high-pressure accumulator, the volume of the high-pressure accumulator is divided into two individual volumes. The smaller of the two individual volumes of the relevant high-pressure accumulator (common rail) fulfills the function of the distributor block that was previously embodied in the form of a separate component. The smaller volume of the relevant high-pressure accumulator representing the distributor block is preferably situated at the end of the high-pressure accumulator to which the high-pressure lines are connected, which are connected to the high-pressure pump and supply fuel to the relevant high-pressure accumulator. This high-pressure accumulator into which the distributor block is integrated supplies fuel the other high-pressure accumulator via a connecting line, which has a damping throttle integrated into its end that opens into the other high-pressure accumulator.

On the one hand, the embodiment proposed according to the invention—in which the distributor block, which was previously embodied in the form of a separate component, is integrated into one of the high-pressure accumulators—avoids the use of a bulky separate component between the two high-pressure accumulators so that the fuel injection system proposed according to the invention takes up less space in the cylinder head region of the multicylinder internal combustion engine. In addition, eliminating a separate component that must be embodied as pressure-tight achieves a not insignificant cost advantage. According to the invention, the distributor block integrated into one of the high-pressure accumulators likewise damps pressure fluctuations that can occur in the fuel injection system and is therefore equivalent in function to a distributor block that was previously produced as a separate component.

There are a number of embodiment variations for implementation of the integrated throttle and the resulting division of the high-pressure accumulator volume into two individual volumes:

The integrated throttle can, for example, be embodied in the form of a bore in a diametrical partition wall of the high-pressure accumulator (common rail). According to this embodiment variation, the cavity is delimited by a deep-hole bore introduced into the two ends of the tubular high-pressure accumulator. A throttle equipped with a stepped throttle conduit can then be introduced into the partition wall that separates the two deep-hole bore sections. In a modification of this embodiment variation, the end regions of the deep-hole bores introduced into the two ends of the high-pressure accumulator can also be rounded in order to improve the flow properties of the fuel inside the cavity of the high-pressure accumulator. In another embodiment variation, a continuous cavity, which can be embodied for example in the form of a through bore in the body of the high-pressure accumulator, can have a sleeve-shaped component mounted in it, whose one end, preferably the end oriented toward the middle region of the high-pressure accumulator, has a throttle opening provided in its end surface. This sleeve-shaped insert can be mounted in the cavity of the high-pressure accumulator by means of a fitting to which the pressure line from the high-pressure pump is connected. In a modification of this embodiment variation, the connection, which is acted on by the high-pressure pump, and the sleeve, which has a throttle bore at the end and is mounted in the cavity of the high-pressure accumulator, can also be produced in the form of a single insert component that can, for example, be mounted at an end surface in the high-pressure accumulator by means of a biting edge.

In another embodiment variation of the integrated throttle proposed according to the invention, the throttle can also be integrated into the cavity of the high-pressure accumulator in the form of a press-fitted throttle that includes a ring element and a throttle element. According to this embodiment variation, the integrated throttle can also be embodied in the form of a multipart component that includes a ring element and a throttle element. In lieu of a press-fitted throttle that is press-fitted into the cavity of the high-pressure accumulator the integrated throttle can also be embodied in the form of a clamped throttle that is mounted in the cavity of the relevant high-pressure accumulator (common rail) by means of an annular clamping element. According to this embodiment variation, the position of the integrated throttle inside the cavity of the high-pressure accumulator can be selectively chosen so that it is also possible to freely select and freely predetermine the two individual volumes inside the high-pressure accumulator.

In another embodiment variation, the integrated throttle can be embodied in the form of a two-part component that includes a screw part and a threaded part; the threaded part and the screw part both rest against a diametrical step on the inner wall of the cavity of the high-pressure accumulator and are screw-connected to each other. The screw connection integrates the integrated throttle into the cavity of the relevant high-pressure accumulator (common rail).

BRIEF DESCRIPTION OF THE DRAWING

The invention will be explained in greater detail below in conjunction with the drawings, in which:

FIG. 5 shows an embodiment variation of the integrated throttle that is embodied in the form of a press-fitted throttle, FIG. 5.1 shows a one-piece integrated throttle embodied in the form of a press-fitted throttle element, FIG. 5.2 shows a throttle that is integrated into the cavity of the high-pressure accumulator by means of an annular clamping element, and FIG. 5.3 shows a two-piece integrated throttle that includes a threaded part and a screw part.

DESCRIPTION OF THE PREFERRED EMBODIMENTS

Figure 1:
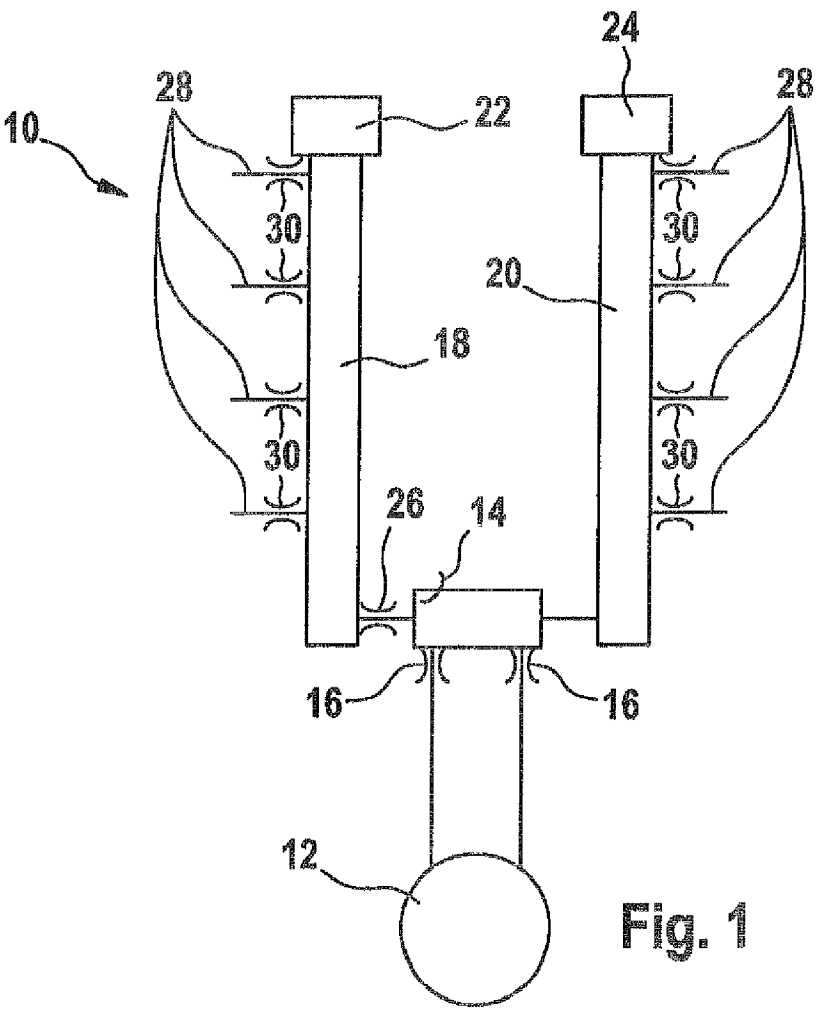
FIG. 1 shows a fuel injection system according to the prior art, with a distributor block that is produced as a separate component.

FIG. 1 shows a fuel injection system for multicylinder internal combustion engines known from the prior art in which the distributor block is embodied in the form of a separate component.

FIG. 1 shows that a fuel injection system 10 includes a high-pressure pump 12 that acts on a distributor block 14, which is embodied in the form of a separate component, with fuel. The lines that extend from the high-pressure pump 12 to the distributor block 14 each have distributor block throttles 16, which damp the pressure pulsations in the fuel injection system 10. The distributor block 14 supplies fuel at system pressure to a first high-pressure accumulator 18 (common rail) and a second high-pressure accumulator 20 (common rail). The system pressure that prevails in the first high-pressure accumulator 18 and second high-pressure accumulator 20 depends on the design of the high-pressure pump 12. The first high-pressure accumulator 18 is associated with a rail pressure sensor 22 while the second high-pressure accumulator 20 is associated with a pressure control valve 24. The distributor block 14 acts on the first high-pressure accumulator 18 via a pressure line whose end has a damping throttle 26 embodied in it at its entry to the first high-pressure accumulator 18.

Each of the two high-pressure accumulators 18 and 20 includes four injector supply lines 28, which can each have a respective supply line throttle 30 integrated into them in order to damp pressure pulsations between the fuel injectors, not shown in FIG. 1, and the respective high-pressure accumulators 18 and 20. In the embodiment variation of the fuel injection system 10 shown in FIG. 1, the two high-pressure accumulators 18 and 20 each supply fuel at system pressure to four fuel injectors that are associated with the respective cylinders of two cylinder banks of a multicylinder internal combustion engine.

Figure 2:
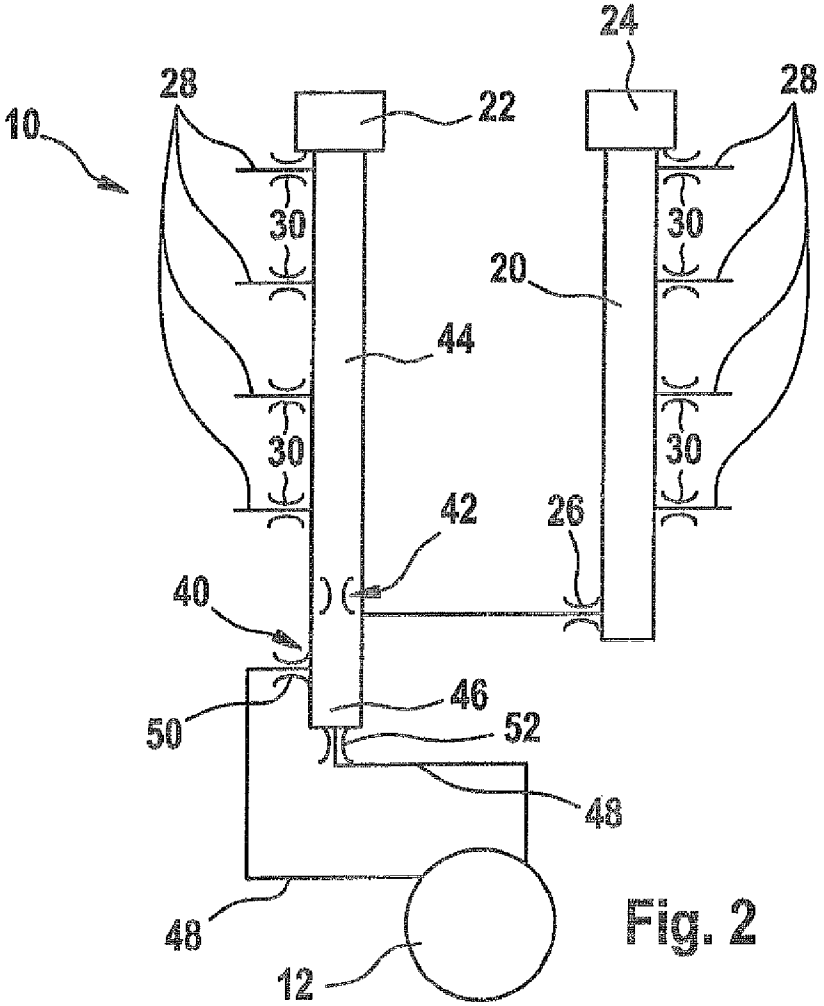
FIG. 2 shows the fuel injection system proposed according to the invention, in which the distributor block is integrated into one of the high-pressure accumulators (common rails), FIG. 3.1 shows an integrated throttle embodied in the form of a through bore in the high-pressure accumulator, FIG. 3.2 shows an embodiment variation of the integrated throttle shown in FIG. 3.1 in which the end surfaces of sections of a deep-hole bore in the high-pressure accumulator are embodied as rounded, FIG. 4.1 shows an embodiment variation of the integrated throttle that is embodied in the form of a sleeve-shaped body, which is inserted into the cavity of the high-pressure accumulator, FIG. 4.2 shows an embodiment variation in which the integrated throttle is embodied in the form of a one-piece component that includes a sleeve-shaped section and a connecting piece.

FIG. 2 shows the fuel injection system 10 proposed according to the invention.

FIG. 2 shows that the fuel injection system 10 has a high-pressure accumulator 40 equipped with an integrated distributor block. To achieve this, the high-pressure accumulator 40 equipped with the integrated distributor block is embodied as elongated in comparison to the second high-pressure accumulator 20. The two high-pressure accumulators 20 and 40 are embodied as essentially tubular. The high-pressure accumulator 40 equipped with the integrated distributor block is associated with the rail pressure sensor 22 while the second high-pressure accumulator 20 is associated with the pressure control valve 24. The high-pressure accumulators 20, 40 are each associated with four injector lines 28, each of which contains a supply line throttle 30. The fuel injection system 10 shown in FIG. 2 is therefore able to supply fuel at system pressure to the cylinders of two cylinder banks of an 8-cylinder internal combustion engine. It is naturally also possible to modify the fuel injection system 10 according to FIG. 2 so that in lieu of the embodiment variation of the fuel injection system 10 shown in FIG. 2 for 8-cylinder internal combustion engines, it is also possible for a six-cylinder engine in a V arrangement to be equipped with the fuel injection system proposed according to the invention and furthermore, for internal combustion engines that have an even larger number of cylinders to be equipped with it.

By contrast with the first high-pressure accumulator 18 shown in FIG. 1, the high-pressure accumulator 40 equipped with the integrated distributor block has an integrated throttle 42 so that its total volume is divided into a first high-pressure accumulator volume 44 and a second high-pressure accumulator 46. The first high-pressure accumulator volume 44 is larger than the second high-pressure accumulator 46, which serves as an integrated distributor block inside the high-pressure accumulator 40. The second high-pressure accumulator 46, i.e. the distributor block integrated into the high-pressure accumulator 40, is preferably situated at the end at which the high-pressure accumulator 40 equipped with the integrated distributor block is acted on with high-pressure fuel by the high-pressure pump 12 via pressure lines 48. Each of the supply lines 48 between the high-pressure pump 12 and the second high-pressure accumulator volume 46 contains a respective pressure line throttle 50, 52, which damps pressure pulsations between the high-pressure pump 12 and the high-pressure accumulator 40 equipped with the integrated distributor block.

The second high-pressure accumulator volume 46 in the high-pressure accumulator 40 equipped with the integrated distributor block communicates with the second high-pressure accumulator 20 via a connecting line that contains a damping throttle 26. The second high-pressure accumulator 20 is embodied the same as the second high-pressure accumulator 20 shown in FIG. 1.

The fuel injection system 10 according to the invention shown in FIG. 2 eliminates the need for the distributor block 14 depicted as a separate component in FIG. 1, as a result of which the fuel injection system 10 proposed according to the invention requires less space in the cylinder head region of a multicylinder internal combustion engine with two cylinder banks.

FIG. 3.1 shows an embodiment variation of the integrated throttle, which is embodied in the form of a through bore.

FIG. 3.1 shows that the high-pressure accumulator 40 equipped with the integrated distributor block has a cavity 54. The cavity 54 is respectively defined by a respective section of a deep-hole bore 56 that is introduced into the two ends of the high-pressure accumulator 40 equipped with the integrated distributor block. The remaining partition wall in the cavity 54 of the high-pressure accumulator 40 equipped with the integrated distributor block contains an integrated throttle 42 that can be embodied in the form of a through bore 62. The volume of the second high-pressure accumulator 46 inside the cavity 54 comprised by one section of the deep-hole bore 56 is delimited at one end by the integrated throttle 42 and at the other end by a connection 64 to which the high-pressure pump 12 is connected. An integrated damper throttle 66 can be embodied in the connection 64 for the high-pressure pump 12. In the embodiment variation shown in FIG. 3.1, the connection of the injector supply line 28 is labeled with the reference numeral 60 and press-fitted throttles 58 are mounted into the wall 68 of the high-pressure accumulator 40 equipped with the integrated distributor block. The press-fitted throttles 58 damp pressure pulsations between the fuel injectors, not shown in FIG. 3.1, and the cavity 54 of the high-pressure accumulator 40 equipped with the integrated distributor block.

FIG. 3.2 shows an embodiment variation of the integrated throttle shown in FIG. 3.1. In the depiction in FIG. 3.2, the integrated throttle 42 is likewise embodied in the form of a through-bored throttle 62 with a stepped throttle conduit, but the end surfaces of the two bore sections of the deep-hole bore 56 in the high-pressure accumulator 40 equipped with the integrated distributor block are each provided with a rounded region 70. This improves the strength properties of the high-pressure accumulator 40 equipped with the integrated distributor block since it avoids the notch effect. The cavity 54 and the second high-pressure accumulator volume 46 are supplied with high-pressure fuel directly by the high-pressure pump 12 that acts on the connection 64 via the pressure line 48. The embodiment variation of the fuel injection system 10 proposed according to the invention shown in FIG. 3.2 also has press-fitted throttles 58, which are mounted into the wall 68 of the high-pressure accumulator 40 equipped with the integrated distributor block and serve to damp pressure pulsations between the cavity 54 and the injector supply lines 28, which are connected to the connections 60 and lead to the fuel injectors of the multicylinder internal combustion engine. The rounded regions 70 also achieve a more uniform flow formation for the integrated throttle 42 embodied in the form of a through-bored throttle 62 that divides the second high-pressure accumulator volume 46 from the first high-pressure accumulator volume 44 inside the cavity 54.

FIG. 4.1 shows another embodiment variation of the integrated throttle that is situated in a sleeve-shaped component, which is inserted into the cavity of the high-pressure accumulator with the integrated distributor block.

FIG. 4.1 shows that the cavity 54 of the high-pressure accumulator 40 equipped with the integrated distributor block is divided into a volume of the first high-pressure accumulator 44 and a volume of the second high-pressure accumulator 46 by a sleeve 72 that has an end surface provided with a throttle bore. The sleeve 72 has an end surface in which the integrated throttle 42 is embodied in the form of an easily manufacturable bore. The sleeve 72 is mounted in the cavity 54 of the high-pressure accumulator 40 equipped with the integrated distributor block by means of the connection 64 for the pressure line 48 of the high-pressure pump 12. To accomplish this, the connection 64 for the pressure line 48 of the high-pressure pump 12 has a biting edge 74, which is mounted in the bore diameter 46 in the connection region in a frictionally engaging or form-locked manner and acts on the sleeve 72 with the integrated throttle 42 mounted in the cavity 54. The wall 68 of the high-pressure accumulator 40 equipped with the integrated distributor block accommodates the above-mentioned press-fitted throttles 58, beneath the connections 60 to which the injector supply lines 28 are connected, which lines lead to the fuel injectors to be supplied with the fuel at system pressure.

FIG. 4.2 shows an embodiment variation of the configuration shown in FIG. 4.1.

FIG. 4.2 shows that the components shown in FIG. 4.1, namely the sleeve 72 and the connection 64 for the pressure line 48 of the high-pressure pump, can be embodied of one piece in the form of a common insert part 78. The insert part 78 includes the connection for the pressure line 48 of the high-pressure pump 12 as well as the sleeve. At its end oriented toward the cavity 54, the one-piece insert part 78 has an end surface in which the integrated throttle 42 is likewise embodied in the form of a simple bore. The insert part 78 delimits the volumes of the first high-pressure accumulator 44 and the second high-pressure accumulator 46 in the cavity 54 of the high-pressure accumulator 40 equipped with the integrated distributor block. By contrast with the embodiment variation shown in FIG. 4.1, the wall 68 of the high-pressure accumulator 40 equipped with the integrated distributor block does not contain press-fitted throttles 58; instead, the damper throttles 30 are implemented in the form of simple bores in the wall 68 of the high-pressure accumulator 40 equipped with the integrated distributor block and are situated beneath the connections 60 for the injector supply lines 28.

FIG. 5 shows an embodiment variation for an integrated throttle that is embodied in the form of a press-fitted throttle.

Inside the high-pressure accumulator 40 equipped with the integrated distributor block, the integrated throttle 42 embodied in the form of a press-fitted throttle 80 divides the second high-pressure accumulator volume 46 from the first high-pressure accumulator volume 44. The location of the press fit, i.e. in the axial length of the cavity 54 in which the integrated throttle 42 embodied in the form of a press-fitted throttle 80 is mounted, can exactly predetermine the sizes of the first high-pressure accumulator volume 44 and second high-pressure accumulator volume 46 in the cavity 54 of the high-pressure accumulator 40 equipped with the integrated distributor block. In the embodiment variation of the press-fitted throttle 80 shown in FIG. 5, it has a ring element 82 and a throttle element 84. The ring element 82 rests against an inner wall that delimits the cavity 54 of the high-pressure accumulator 40 equipped with the integrated distributor block. The wall 68 of the high-pressure accumulator 40 equipped with the integrated distributor block once again contains damper throttles 30 embodied the form of simple bores that extend perpendicular to the cavity 54, beneath the connections 60 for the injector supply lines 28.

FIG. 5.1 shows an embodiment variation of an integrated throttle embodied in the form of a press-fitted throttle.

FIG. 5.1 shows that an inner wall 94 of the high-pressure accumulator 40 equipped with the integrated distributor block has a diametrical step 86 embodied in it, against which a collar of the throttle element 84 rests. The throttle element 84 has a throttle conduit 88 with a diametrical step passing through it and divides the volume of the first high-pressure accumulator 44 from the volume of the second high-pressure accumulator 46. The collar that is embodied on the throttle element 84 is oriented toward the second high-pressure accumulator line 46, inside the cavity 54 of the high-pressure accumulator 40 equipped with the integrated distributor block.

FIG. 5.2 shows an embodiment variation of the integrated throttle, which can be mounted in the high-pressure accumulator by means of an annular clamping element.

FIG. 5.2 shows that a clamped throttle 92 is mounted to the wall 68, against the inner wall 94 of the high-pressure accumulator 40 equipped with the integrated distributor block, by means of an annular clamping element 90. According to the embodiment variation shown in FIG. 5.2, the installation site of the integrated throttle 42 in the high-pressure accumulator 40 equipped with the integrated distributor block can be freely selected in accordance with the division of the volumes of the high-pressure accumulators 44 and 46. The clamped throttle 92 also has a throttle conduit 88 with a diametrical step.

FIG. 5.3 shows an embodiment variation for an integrated throttle that is composed of two parts and includes a screw connection.

FIG. 5.3 shows that the integrated throttle 42 is embodied in the form of a screw-mounted throttle 96 and has a screw part 98 and a threaded part 100. Both the threaded part 100 and the screw part 98 rest against a diametrical step 86, which is embodied on the inner wall 94 of the high-pressure accumulator 40 equipped with the integrated distributor block. The threaded part 100 and the screw part 98 each have a tool attachment socket 102 by means of which the screw part 98 and threaded part 100 are screwed together until their respective end surfaces come to rest against the diametrical step 86 of the inner wall 96 of the high-pressure accumulator 40 equipped with the integrated distributor block and are tightened in relation to each other there with a definite torque. The screw part 98 contains the above-mentioned throttle conduit 88 with the diametrical step. The embodiment variations of the integrated throttle 42 shown in FIGS. 5, 5.1, 5.2, and 5.3 can likewise be used to divide the high-pressure accumulator 40 equipped with the integrated distributor block shown in FIG. 2 into a first high-pressure accumulator 44 and a second high-pressure accumulator 46, with the volume of the second high-pressure accumulator 46 serving as an integrated distributor block in which pressure pulsations in the fuel at system pressure are damped. The second high-pressure accumulator 46 that constitutes the integrated distributor block is advantageously connected to the second high-pressure accumulator 20 via a connecting line containing a damping throttle 26, as shown in FIG. 2.

While pressure pulsations that occur at the fuel injectors during the process of injection into the combustion chambers of an internal combustion engine are damped by the throttles 30 and 58 embodied in the injector supply lines 28, pressure pulsations between the high-pressure pump 12 that are transmitted through the pressure lines 48 are damped by means of the second high-pressure accumulator volume 46 in the high-pressure accumulator 40 equipped with the integrated distributor block.

The foregoing relates to the preferred exemplary embodiment of the invention, it being understood that other variants and embodiments thereof are possible within the spirit and scope of the invention, the latter being defined by the appended claims.

The invention claimed is:

1. A fuel injection system for a multicylinder internal combustion engine, comprising:

a first high-pressure accumulator;

a second high-pressure accumulator, the first and second high-pressure accumulators each having a number of connections for injector supply lines corresponding to the number of cylinders of the internal combustion engine;

said first high-pressure accumulator being divided into a first high-pressure accumulator volume and a second high-pressure accumulator volume by a sleeve, said second high-pressure accumulator volume serving as a damping volume and as an integrated distributor block, a high-pressure pump; and a damping volume damping pressure pulsations between the high-pressure accumulators and the high-pressure pump, wherein the damping volume is integrated into one of the high-pressure accumulators, wherein the second high-pressure accumulator volume that serves as the damping volume is located at an end of the first high-pressure accumulator oriented toward the high-pressure pump.

2. The fuel injection system as recited in claim 1, wherein the second high-pressure accumulator volume is smaller than the first high-pressure accumulator volume.

3. The fuel injection system as recited in claim 1, wherein a connecting line equipped with a damper throttle extends from the second high-pressure accumulator volume to the second high-pressure accumulator.

4. A fuel injection system as recited in claim 1, wherein said injection system is positioned in a multicylinder internal combustion engine having two cylinder banks.

5. A fuel injection system as recited in claim 2, wherein said injection system is positioned in a multicylinder internal combustion engine having two cylinder banks.

6. A fuel injection system as recited in claim 3, wherein said injection system is positioned in a multicylinder internal combustion engine having two cylinder banks.

7. A fuel injection system as recited in claim 1, wherein a connection for a pressure line for said high pressure pump is located at an end of said sleeve that is opposite said end surface.

8. A fuel injection system as recited in claim 7, wherein said connection is an element, separate from said sleeve, that mounts said sleeve within said first high-pressure accumulator.

9. A fuel injection system as recited in claim 7, wherein said connection and said sleeve are unitary and are formed of a single piece of material.

10. A fuel injection system for a multicylinder internal combustion engine, comprising:

a first high-pressure accumulator;

a second high-pressure accumulator, the first and second high-pressure accumulators each having a number of connections for injector supply lines corresponding to the number of cylinders of the internal combustion engine;

said first high-pressure accumulator being divided into a first high-pressure accumulator volume and a second high-pressure accumulator volume by a sleeve, said second high-pressure accumulator volume serving as a damping volume and as an integrated distributor block, wherein one end of said sleeve has an end surface provided with a throttle bore which extends through said end surface, said end surface of said sleeve forming a divider between said first high-pressure accumulator volume, which is outside the sleeve, and said second high-pressure accumulator volume, which is inside the sleeve, a high-pressure pump; and a damping volume damping pressure pulsations between the high-pressure accumulators and the high-pressure pump, wherein the damping volume is integrated into one of the high-pressure accumulators.

11. A fuel injection system for a multicylinder internal combustion engine, comprising:

a first high-pressure accumulator;

a second high-pressure accumulator, the first and second high-pressure accumulators each having a number of connections for injector supply lines corresponding to the number of cylinders of the internal combustion engine;

said first high-pressure accumulator being divided into a first high-pressure accumulator volume and a second high-pressure accumulator volume by a clamped throttle, said second high-pressure accumulator volume serving as a damping volume and as an integrated distributor block, wherein said clamped throttle is mounted to a wall of said first high-pressure accumulator by an annular clamping element, a high-pressure pump; and a damping volume damping pressure pulsations between the high-pressure accumulators and the high-pressure pump, wherein the damping volume is integrated into one of the high-pressure accumulators.

12. A fuel injection system as recited in claim 11, wherein said clamped throttle has a throttle conduit with a diametrical step.

13. A fuel injection system for a multicylinder internal combustion engine, comprising:

a first high-pressure accumulator;

a second high-pressure accumulator, the first and second high-pressure accumulators each having a number of connections for injector supply lines corresponding to the number of cylinders of the internal combustion engine;

said first high-pressure accumulator being divided into a first high-pressure accumulator volume and a second high-pressure accumulator volume by a screw-mounted throttle having a throttle conduit located therein, wherein said screw-mounted throttle has a screw part and a threaded part which are screwed together to form the throttle, a high-pressure pump; and a damping volume damping pressure pulsations between the high-pressure accumulators and the high-pressure pump, wherein the damping volume is integrated into one of the high-pressure accumulators.

14. A fuel injection system as recited in claim 13, wherein an inner surface of said first high-pressure accumulator has a diametrical step, said step having opposing surfaces, and wherein the screw part and the threaded part are screwed together such that an end surface of each part rests against one of said opposing surfaces of said diametrical step.

15. A fuel injection system as recited in claim 14, wherein said throttle conduit is located in said screw part.

16. A fuel injection system as recited in claim 13, wherein said throttle conduit is located in said screw part.

17. A fuel injection system as recited in claim 14, wherein said throttle conduit has a diametrical step.

18. A fuel injection system as recited in claim 15, wherein said throttle conduit has a diametrical step.

19. A fuel injection system as recited in claim 16, wherein said throttle conduit has a diametrical step.

* * * * *